US010488051B2

(12) United States Patent
Moon et al.

(10) Patent No.: US 10,488,051 B2
(45) Date of Patent: Nov. 26, 2019

(54) GAS BURNER APPARATUS AND COOKING APPARATUS INCLUDING THE SAME

(71) Applicant: SAMSUNG ELECTRONICS CO., LTD., Suwon-si (KR)

(72) Inventors: Seong-cheol Moon, Anyang-si (KR); Tetsuji Kitashima, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 237 days.

(21) Appl. No.: 15/293,692

(22) Filed: Oct. 14, 2016

(65) Prior Publication Data

US 2017/0108226 A1 Apr. 20, 2017

(30) Foreign Application Priority Data

Oct. 14, 2015 (KR) ..... 10-2015-0143212

(51) Int. Cl.
*F24C 3/08* (2006.01)
*F24C 3/02* (2006.01)
(Continued)

(52) U.S. Cl.
CPC ..... *F24C 3/082* (2013.01); *F23D 14/06* (2013.01); *F23D 14/70* (2013.01); *F23D 23/00* (2013.01);
(Continued)

(58) Field of Classification Search
CPC ..... F24C 3/082; F24C 3/022; F24C 3/085; F23D 14/06; F23D 23/00; F23D 14/70;
(Continued)

(56) References Cited

U.S. PATENT DOCUMENTS 7,291,009 B2 11/2007 Kamal et al.
8,932,049 B2 1/2015 Ryu et al.
(Continued)

FOREIGN PATENT DOCUMENTS

CN 2140028 8/1993
CN 2791485 6/2006
(Continued)

OTHER PUBLICATIONS

Form PCT/ISA/237; Written Opinion dated Feb. 1, 2017 in related International Patent Application No. PCT/KR2016/011519 (8 pages).
(Continued)

*Primary Examiner* — Jorge A Pereiro
(74) *Attorney, Agent, or Firm* — Staas & Halsey LLP

(57) ABSTRACT

A gas burner apparatus and a cooking apparatus including the same are provided. The gas burner apparatus a first burner, a second burner spaced apart from a lower side of the first burner, a support plate on which the second burner is disposed, and a secondary air supply flow channel to supply secondary air to the first burner, the secondary air supply flow channel including a first secondary air supply flow path formed between the first and second burners and a second secondary air supply flow path starting from an area lower than the support plate, the first and second paths being connected to each other.

20 Claims, 16 Drawing Sheets

(51) Int. Cl.

| | |
|---|---|
| ***F23L 9/00*** | (2006.01) |
| ***F23D 14/06*** | (2006.01) |
| ***F23D 14/70*** | (2006.01) |
| ***F23D 23/00*** | (2006.01) |
| *F24C 3/10* | (2006.01) |

(52) U.S. Cl.
CPC ..... *F23L 9/00* (2013.01); *F24C 3/022* (2013.01); *F24C 3/085* (2013.01); *F23D 2900/14062* (2013.01); *F24C 3/103* (2013.01)

(58) Field of Classification Search
CPC ... F23D 2900/14062; F23D 14/02; F23L 9/00
See application file for complete search history.

(56) References Cited

U.S. PATENT DOCUMENTS

| | | | | |
|---|---|---|---|---|
| 2006/0051718 | A1* | 3/2006 | Kamal | F23D 14/06 431/354 |
| 2010/0101557 | A1 | 4/2010 | Gasparini | |
| 2010/0186730 | A1 | 7/2010 | Cadeau et al. | |
| 2010/0326420 | A1* | 12/2010 | Gasparini | F23D 14/08 126/39 E |
| 2012/0090595 | A1 | 4/2012 | Shaffer et al. | |
| 2014/0345597 | A1 | 11/2014 | Lim et al. | |
| 2016/0363325 | A1* | 12/2016 | Cadima | F24C 3/08 |

FOREIGN PATENT DOCUMENTS

| | | |
|---|---|---|
| CN | 203010612 | 6/2013 |
| DE | 3918722 | 11/1990 |
| EP | 0485645 | 5/1992 |
| EP | 2503237 | 9/2012 |
| KR | 10-2011-0054929 A | 5/2011 |

OTHER PUBLICATIONS

Form PCT/ISA/210; International Search Report dated Feb. 1, 2017 in related International Patent Application No. PCT/KR2016/011519 (3 pages).
Extended European Search Report dated Aug. 20, 2018 in European Patent Application No. 16855757.7.
Chinese Office Action dated May 7, 2019 in Chinese Patent Application No. 201680060183.3.

* cited by examiner

GAS BURNER APPARATUS AND COOKING APPARATUS INCLUDING THE SAME

CROSS-REFERENCE TO RELATED APPLICATIONS

This application claims priority from Korean Patent Application No. 10-2015-0143212, filed on Oct. 14, 2015 in the Korean Intellectual Property Office, the disclosure of which is incorporated herein by reference in its entirety.

BACKGROUND OF THE INVENTION

Field of the Invention

Apparatuses and methods consistent with the present disclosure relate to a gas burner apparatus and a cooking apparatus including the same, and more particularly, to a gas burner apparatus and a cooking apparatus including the same, for sufficiently supplying secondary air to an upper burner to maximize output of the upper burner and minimizing output of a lower burner so as to achieve satisfactory simmering.

Description of the Related Art

A cooking apparatus including a gas burner is an apparatus for cooking food using gas as fuel. The gas burner of the cooking apparatus burns gas and injects flames for heating a cooking container that contains food.

In general, a gas burner with two or more burner ports is classified into a horizontal-type gas burner or a stack-type gas burner. Such gas burners are designed to concentrate on a high turn down ratio (TDR, a ratio of maximum input to burner input) and satisfactory simmering. In the horizontal-type gas burner, burners are radially arranged on a horizontal surface, an external burner and an internal burner are simultaneously used in a power mode, and the internal burner is used in a simmering mode, in general. In the stack-type gas burner, vertically stacked upper and lower burners are simultaneously used in a power mode and one of the upper and lower burners is used in a simmering mode.

In addition, a typical gas burner receives secondary air from the periphery of flame above a cook top during gas combustion. That is, most burners receive secondary air from an upper side of a cook top of a cooking apparatus. Accordingly, a typical stack-type gas burner is not capable of sufficiently supplying secondary air to an upper burner and, thus, it is difficult to increase output of the upper burner. Accordingly, there is a problem in terms of reduction in overall output of a gas burner.

SUMMARY OF THE INVENTION

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides a gas burner apparatus and a cooking apparatus including the same, for maximizing output of an upper burner to achieve high output and to reduce a boiling time and minimizing output of a lower burner to achieve satisfactory simmering.

The present disclosure provides a gas burner apparatus and a cooking apparatus including the same, for supplying a sufficient amount of secondary air to an upper burner and satisfactorily forming flames injected from the upper burner.

According to an aspect of the present disclosure, a gas burner apparatus includes a first burner configured to receive gas mixed with primary air and to inject flames through a plurality of burner ports, a second burner spaced apart from a lower side of the first burner and configured to receive gas mixed with primary air and to inject flames through a plurality of burner ports, a support plate on which the second burner is installed, and a secondary air supply flow path connected to a path between the first and second burners, spaced apart from a lower side of the support plate.

The first burner may include a mixture gas supply pipe that is formed sequentially through the second burner and a through hole of the support plate, and the through hole of the support plate may have an inner circumference surface that is spaced apart from an outer circumferential surface of the mixture gas supply pipe to form a portion of the secondary air supply flow path.

The support plate may include a shielding rib that extends toward the first burner from the through hole of the support plate.

The secondary air supply flow path may include a path between the shielding rib and the mixture gas supply pipe.

The support plate and the second burner may be spaced apart from each other, and the gas burner apparatus may include a liquid (for example, soup) discharging flow path including a path between the first and second burners, a path between an internal side of the second burner and an external side of the mixture gas supply pipe, and a path between the support plate and the second burner.

Outlines of the first and second burners may or may not correspond to each other.

At least a portion of the first burner may be positioned within the outline of the second burner. The outline of the first burner may be formed like a non-circle and the first burner may include at least one concave portion, the outline of the second burner may be formed like a circle, and at least one burner port may be formed in the concave portion.

Some of the plurality of burner ports of the first burner may be spaced apart from each other at the same interval and the remaining burner ports may be spaced apart from each other at different intervals. The plurality of burner ports of the first burner may be spaced apart from each other at different intervals.

The first burner may include at least one separation block so as to widen an interval between adjacent burner ports. The separation block may have a width of 1.2 times an interval between adjacent burner ports of the first burner.

The plurality of burner ports of the first burner may be inclined upward. The plurality of burner ports of the first burner may be formed by a head and a cap for closing the head, included in the first burner, and the head may include a first inclined block with a first inclination angle and a second inclined block with a second inclination angle.

The first inclination angle is 30 to 45 degrees from a horizontal surface and the second inclination angle is 35 to 50 degrees from a horizontal surface.

The plurality of burner ports of the second burner may be inclined upward. The burner ports of the second burner may include at least one main burner port in charge of output power of the second burner and an auxiliary burner port for moving flames to the first burner. The at least one main burner port of the second burner may be disposed at a location corresponding to any one of the plurality of burner ports of the first burner.

A total area of the plurality of burner ports of the first burner may be larger than a total area of the main burner port of the second burner.

The gas burner apparatus may further include an orifice holder detachably coupled to a lower side of the support plate and configured to supply mixture gas to the first and second burners, wherein the orifice holder may include that is shaped like a tub surrounding the mixture gas supply pipe with an interval from an external side of the mixture gas supply pipe of the first burner. The shielding member of the orifice holder may be inserted into the through hole of the support plate, and a path between an internal surface of the shielding member of the orifice holder and an external surface of the mixture gas supply pipe of the first burner forms a portion of the secondary air supply flow path.

According to another aspect of the present disclosure, a cooking apparatus includes a body, a gas burner apparatus disposed above the body, and an adjuster installed in the body and configured to combust the gas burner apparatus and to adjust intensity of output power.

Additional and/or other aspects and advantages of the invention will be set forth in part in the description which follows and, in part, will be obvious from the description, or may be learned by practice of the invention.

BRIEF DESCRIPTION OF THE DRAWING FIGURES

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Figure 1:
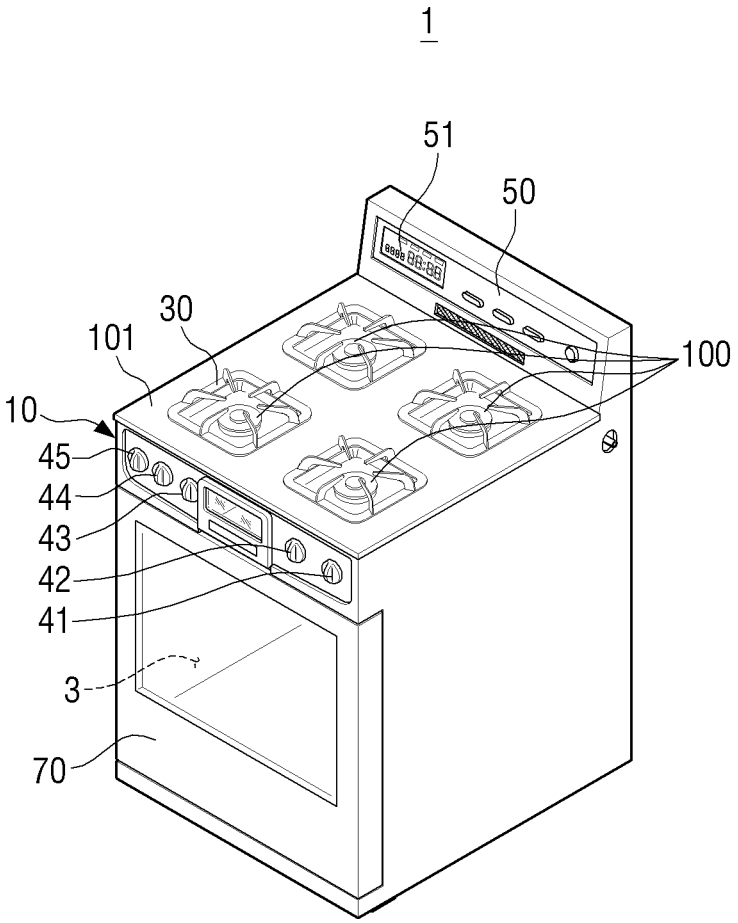
FIG. 1 is a perspective view of a cooking apparatus according to an exemplary embodiment of the present disclosure.

Certain exemplary embodiments of the present disclosure will now be described in greater detail with reference to the accompanying drawings. However, this is not intended to limit the present disclosure to particular modes of practice, and it is to be appreciated that all modifications, equivalents, and/or alternatives that do not depart from the spirit and technical scope of the present disclosure are encompassed in the present disclosure. Like reference numerals in the drawings denote like elements.

It will be understood that, although the terms "first", "second", etc. are used herein to describe various elements irrespective an order and/or importance thereof, are only used to distinguish one element from another element, and are not be limited by these terms. For example, a first element and a second element may indicate different elements irrespective of an order and/or importance thereof. For example, a first element may be termed a second element and a second element may be termed a first element without departing from the teachings of the present disclosure.

The terminology used herein is for the purpose of describing particular embodiments only and is not intended to be limiting of the present disclosure. As used herein, the singular forms "a," "an" and "the" are intended to include the plural forms as well, unless the context clearly indicates otherwise. Unless otherwise defined, all terms including technical and scientific terms used herein have the same meaning as commonly understood by one of ordinary skill in the art described in the present disclosure. It will be further understood that terms, such as those defined in commonly used dictionaries, should be interpreted as having a meaning that is consistent with their meaning in the context of the relevant art and will not be interpreted in an idealized or overly formal sense unless expressly so defined herein. As necessary, even terms defined in the specification are not interpreted to exclude embodiments in the specification.

Hereinafter, with reference to FIGS. 1 to 3B, a cooking apparatus and a gas burner apparatus included in the cooking apparatus will be described with regard to exemplary embodiments of the present disclosure.

Figure 2:
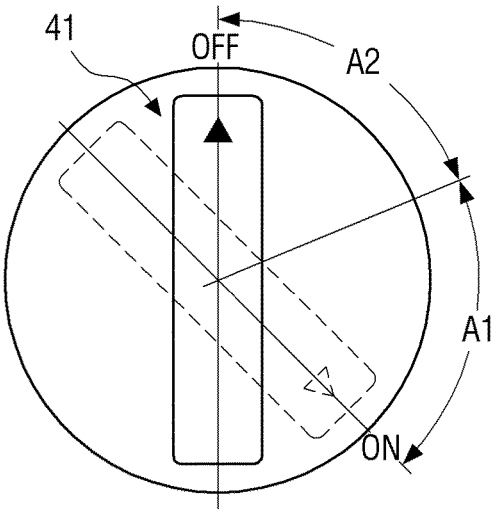
FIG. 2 is a diagram illustrating an example of adjusting output power of a gas burner apparatus according to rotation of control valves illustrated in FIG. 1.
Figure 3A:
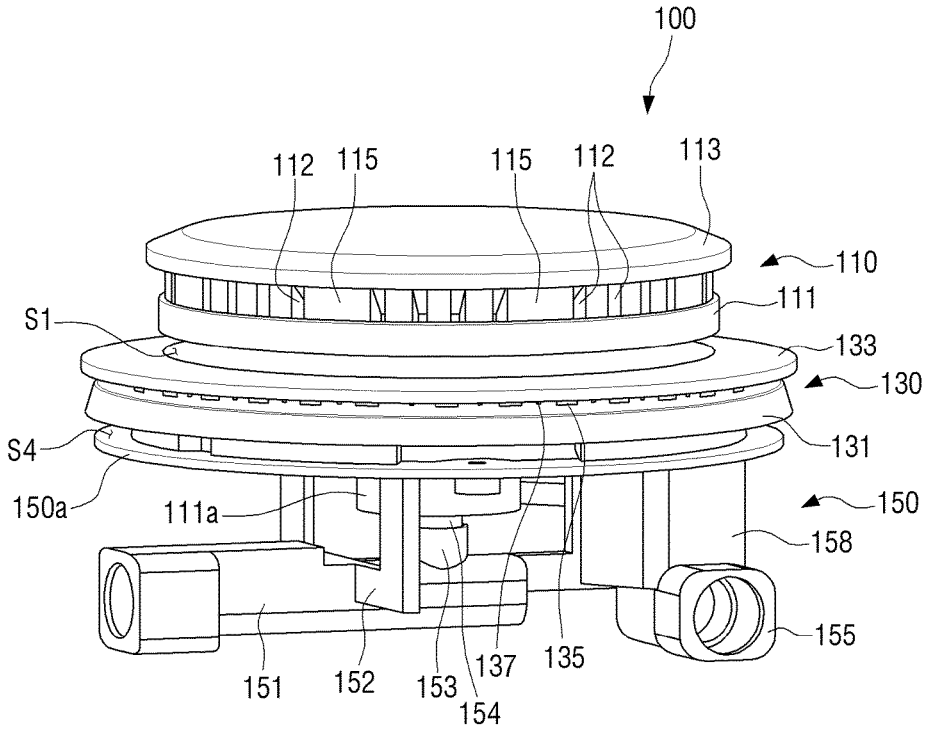
FIG. 3A is a perspective view illustrating an example of a gas burner apparatus included in a cooking apparatus according to an exemplary embodiment of the present disclosure.
Figure 3B:
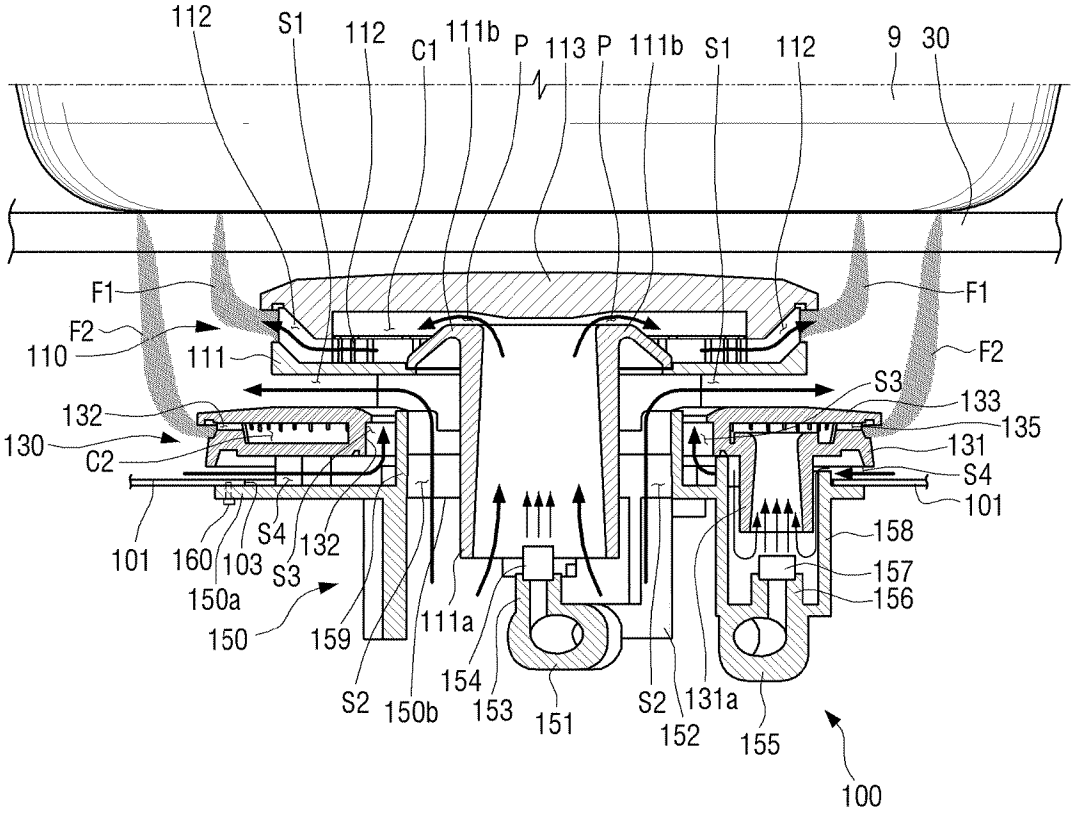
FIG. 3B is a cross-sectional view illustrating the gas burner apparatus illustrated in FIG. 3A.

FIG. 1 is a perspective view of a cooking apparatus 1 according to an exemplary embodiment of the present disclosure. FIG. 2 is a diagram illustrating an example of adjusting output power of a gas burner apparatus 100 according to rotation of control valves 41 to 45 illustrated in FIG. 1. FIG. 3A is a perspective view illustrating an example of the gas burner apparatus 100 included in the cooking apparatus 1 according to an exemplary embodiment of the present disclosure. FIG. 3B is a cross-sectional view illustrating the gas burner apparatus 100 illustrated in FIG. 3A.

The cooking apparatus 1 according to an exemplary embodiment of the present disclosure may include the gas burner apparatus 100 formed at an upper part and may be configured in the form of a built-in type cooking apparatus with at least one cooking room 3 formed therein or a non-built-in type cooking apparatus.

Referring to FIG. 1, the cooking apparatus 1 according to an exemplary embodiment of the present disclosure may include a body 10, a grate 30, a plurality of control valves 41 to 45, a panel portion 50, a door 70, and the gas burner apparatus 100. In this case, in the cooking apparatus 1 according to the present exemplary embodiment, the cooking room 3 that functions as an oven, the door 70 for opening and closing the cooking room 3, and the panel portion 50 may be omitted.

The body 10 may include the cooking room 3 formed therein and include a heater (not shown) for heating food, etc. contained in the cooking room 3 and a blast fan unit (not shown) that inhales outside air inside the body 10, cools the body 10 and, then re-discharges the air out of the body 10.

The grate 30 is a frame that allows a cooking container 9 to be positioned above the gas burner apparatus 100 and is detachably positioned on a support plate 101 to be described later. The grate 30 may be positioned above the gas burner apparatus 100 and a plurality of grates may be used.

The control valves 41 to 45 may be disposed on a front side of an upper portion of the body 10 to facilitate user access. With regard to the control valves 41 to 45, some control valves 41,42,43, and 44 are used for ignition, extinction, and adjustment of output power of each burner included in the gas burner apparatus 100 and the other control valve 45 may be used to turn on/off a heater (not shown) for heating the cooking room 3 as an oven and controlling heater temperature.

In particular, the control valves 41 to 44 for control of output power of the gas burner apparatus 100 may turn on an upper burner 110 and a lower burner 130 or adjust output power of each of the upper burner 110 and the lower burner 130. That is, referring to FIG. 2, when the control valve 41 is set at an angle corresponding to an off-position, gas supply to the upper burner 110 and the lower burner 130 may be shut off. In this state, when the control valve 41 is rotated clockwise to an on-position for ignition, mixture gas may be simultaneously supplied to the upper burner 110 and the lower burner 130 through the orifice holder 150 and flames F1 and F2 (refer to FIG. 3B) may be formed as spark is generated in a spark plug (not shown) and the mixture gas discharged through each burner port of the upper burner 110 and the lower burner 130 is burned. In this case, the control valve 41 may be rotated in a direction (counterclockwise) of rotating an on-position to an off-position, both the upper burner 110 and the lower burner 130 may be turned on in a period A1 (a period in which a power mode to be described later is executed), and the upper burner 110 may be turned off and only the lower burner 130 may be maintained in an on-state in a period A2 (a period in which a simmering mode to be described later is executed). In the period A1, when the control valve 41 is rotated counterclockwise, the amount of the mixture gas supplied to the upper burner 110 is gradually reduced and output power of the upper burner 110 is gradually weakened, and when the control valve 41 is positioned at a boundary between the periods A1 and A2, the mixture gas supplied to the upper burner 110 may be shut off and the upper burner 110 may be turned off. In the period A2, when the control valve 41 is rotated counterclockwise, the amount of the mixture gas applied to the lower burner 130 is gradually reduced and output power of the lower burner 130 is gradually weakened, and when the control valve 41 reaches an off-position, the mixture gas supplied to the lower burner 130 may be shut off and, accordingly, the lower burner 130 may be turned off.

The panel portion 50 may include a display 51 that protrudes on a rear portion of an upper portion of the body 10 and indicates state information of the cooking apparatus 1, such as a temperature and cooking state of a cooking room, to a user. In this case, the panel portion 50 may include a controller (not shown) formed therein that is electrically connected to the display 51 and controls a blast fan, a heater, etc. installed in the body 10. Needless to say, the display 51 may be disposed on a front portion of an upper portion of the body 10, on which the control valves 41 to 45 are positioned, rather than being disposed on the panel portion 50.

The door 70 may have one side hinged to the body 10 so as to open and close the cooking room 3 and include multiple glass layers through which an inner part of the cooking room 3 is checked with the unaided eye. The multiple glass layers may be disposed at a predetermined interval so as to pass air for cooling.

According to an exemplary embodiment of the present disclosure, the gas burner apparatus 100 may be a stack type (which is referred to as a 'vertical type') gas burner in which at least two burners are vertically stacked. Hereinafter, the gas burner apparatus 100 will be described in terms of an example in which the upper burner 110 and the lower burner 130 each have a circular outline. In this case, although the case in which the outline of the upper burner 110 has a diameter smaller than the outline of the lower burner 130 has been described, the present disclosure is not limited thereto, or needless to say, the upper burner 110 and the lower burner 130 may have the same outline.

Hereinafter, with reference to FIGS. 3A and 3B, a structure of the gas burner apparatus 100 will be described in detail. The gas burner apparatus 100 may include the support plate 101, the upper burner 110, the lower burner 130, and the orifice holder 150.

The support plate 101 may include a predetermined through hole 103 that is formed in an upper end portion of the body 10. The support plate 101 may include the lower burner 130 that is positioned on an external upper surface of the support plate 101 and the orifice holder 150 that is detachably coupled to an interior lower (also referable as bottom) surface of the support plate 101.

The support plate 101 may include the through hole 103 with a larger diameter than a diameter of the shielding member 159 of the orifice holder 150 so as to insert a shielding member 159 of the orifice holder 150 to be described later into the through hole 103. The gas burner apparatus 100 according to the present disclosure may sufficiently supply secondary air toward the flame F1 of the upper burner 110 from a lower side of the support plate 101 and, accordingly, the flame F1 injected from the upper burner 110 may be completely combusted so as to contribute to maximize output of the upper burner 110.

The upper burner 110 may inject and use the flame F1 and F2 simultaneously with the lower burner 130 in a power mode during cooking. In a simmering mode, in order to enhance simmering, only the lower burner 130 that is farther disposed from the cooking container 9 than the upper burner 110.

The upper burner 110 may be disposed above the lower burner 130 and spaced apart from an upper end of the lower burner 130 at a predetermined interval. Accordingly, a first path S1 through which secondary air passes may be formed between the upper burner 110 and the lower burner 130. The first path S1 may function as a path for supplying secondary air to the periphery of the upper burner 110 including a plurality of burner ports 112. In addition, when liquid (for example, soup) contained in the cooking container 9 overflows the cooking container 9 during cooking, the first path S1 may also function as a path for discharging overflowing soup through a through hole 132 of the lower burner 130.

The upper burner 110 may include a head 111 with an open upper portion and a cap 113 that closes the upper portion of the head 111. The head 111 may include a mixture gas supply pipe 111*a* that is formed to extend downward from an approximate center.

The mixture gas supply pipe 111*a* may be formed with a smaller diameter than a diameter of the shielding member 159 so as to be inserted into the shielding member 159 of the orifice holder 150 to be described later at an interval from the shielding member 159. In an internal portion of the mixture gas supply pipe 111*a*, gas injected from a nozzle 154 of the orifice holder 150 and primary air may be mixed. The mixture gas supply pipe 111*a* may form a negative pressure therein by gas that is injected into the mixture gas supply pipe 111*a* at high speed. Accordingly, air present in the periphery of a lower end portion of the mixture gas supply pipe 111*a* may be used as primary air that is drawn into the mixture gas supply pipe 111*a* and mixed with gas.

The mixture gas supply pipe 111*a* may be formed with a narrower path P than an internal space of the upper burner 110 as an upper end portion 111*b* protrudes toward a bottom surface of the cap 113 of the upper burner 110. Mixture gas supplied to a chamber C1 of the upper burner 110 from the mixture gas supply pipe 111*a* through the narrow path P may be supplied to the chamber C1 of the upper burner 110 at high speed. The chamber C1 of the upper burner 110 may store mixture gas so as to continuously inject the flame F1 through the burner ports 112 formed along an edge of the upper burner 110.

An external surface of the mixture gas supply pipe 111*a* may be spaced apart from the shielding member 159 of the orifice holder 150 to forma second path S2. The second path S2 may receive secondary air from a lower side of the support plate 101 and may be connected to the first path S1 so as to guide secondary air to the first path S1. As such, the first and second paths S1 and S2 may form a flow channel for supplying secondary air to the periphery of the upper burner 110.

Figure 4:
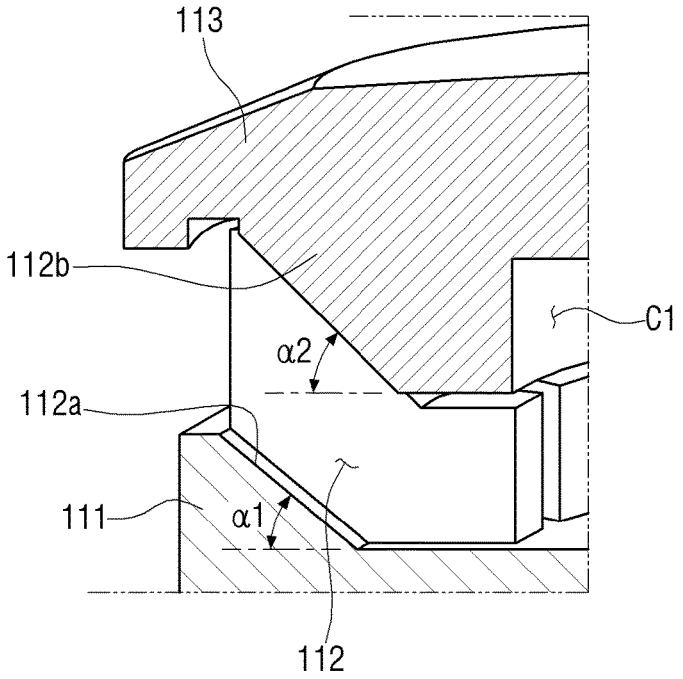
FIG. 4 is an enlarged cross-sectional view of an angle of a burner port of the gas burner apparatus illustrated in FIG. 3B.

By virtue of the secondary air supplied from the lower portion of the support plate 101, when the gas burner apparatus 100 is operated in a power mode, the upper burner 110 may be heated to form radiant heat while the flame F1 is injected from a burner port of the upper burner 110 and, simultaneously, temperature of the second path S2. as well as the periphery of the upper burner 110 may be increased by conductive heat transferred to the orifice holder 150 disposed below the upper burner 110. Accordingly, density of air present in the second path S2 is lowered and, simultaneously, air climbs according to a negative pressure while the air is heated and, thus, the air may be moved to the periphery of the burner ports 112 along the first path S1. In this case, air present below the support plate 101 may climb toward the upper burner 110 with lowered density and may flow into the second path S2. According to such convection current, secondary air may be continuously supplied to the second path S2 from the lower portion of the support plate 101. With reference to FIG. 4, a structure of the burner ports 112 formed in the upper burner 110 will be described. FIG. 4 is an enlarged cross-sectional view of an angle of the burner port 112 of the gas burner apparatus 100 illustrated in FIG. 3B.

The burner port 112 of the upper burner 110 may be formed to couple the head 111 and the cap 113 to each other. The burner port 112 may be formed approximately upward with a predetermined angle. As such, the burner port 112 may be inclined upward in order to increase an angle of the flame F1 to reduce a boiling time period of the upper burner 110.

In order to incline the burner ports 112 upward, the head 111 may include a first inclined block 112*a* that is formed on an upper surface thereof along an internal side of an outline of the head 111 and the cap 113 may include a second inclined block 112*b* that is formed on a bottom surface along an internal side of an outline of the cap 113. A first inclination angle $\alpha 1$ of the first inclined block 112*a* may be set to 25 to 45 degrees, more particularly, 35 degrees from a horizontal surface. A second inclination angle $\alpha 2$ of the second inclined block 112*b* may be set to 35 to 50 degrees, more particularly, 45 degrees from a horizontal surface. In this case, there is a problem in that, when the first inclination angle $\alpha 1$ is greater than 45 degrees or the second inclination angle $\alpha 2$ is greater than 50 degrees, the flame F1 is merged and when the first inclination angle $\alpha 1$ is less than 25 degrees or the second inclination angle $\alpha 2$ is less than 35 degrees, the flame F1 is radially spread and a boiling time is increased.

Figure 5:
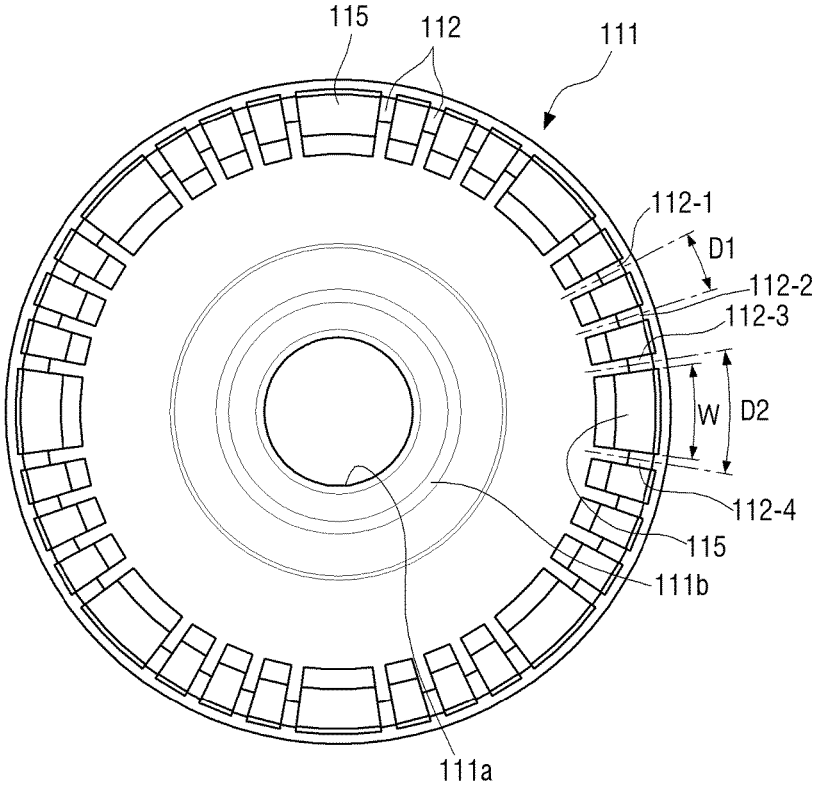
FIG. 5 is a plan view illustrating a head of an upper burner of the gas burner apparatus illustrated in FIG. 3A.

With reference to FIG. 5, an optimum setting interval between the burner ports 112 formed in the head 111 of the upper burner 110 will be described. FIG. 5 is a plan view illustrating the head 111 of the upper burner 110 of the gas burner apparatus 100 illustrated in FIG. 3A.

Burner port load of the upper burner 110 with a smaller size than the lower burner 130 may be increased to enhance output of the upper burner 110. Here, the burner port load may be a value obtained by dividing input of the upper burner 110 by a total burner port area of the upper burner 110. When a pitch as a distance between the burner ports 112 of the upper burner 110 is small, flames injected from the burner ports 112 are merged and secondary air may not be smoothly supplied to each of the burner ports 112 and, thus, the flame F1 may be lengthened and incomplete combustion such as Yellow tip may occur.

Accordingly, in order to achieve large output while minimize a size of the upper burner 110, a separation block 115 may be disposed between a pair of burner ports 112-3 and 112-4 so as to increase an interval D1 between a pair of burner ports 112-1 and 112-2. Accordingly, an interval D2 between the burner ports 112-1 and 112-2, in which the separation block 115 is disposed, may be increased compared with the interval D1 between the burner ports 112-1 and 112-2. Accordingly, the flame F1 injected from the pair of burner ports 112-3 and 112-4 may be prevented from being merged and mixture gas in the chamber C1 of the upper burner 110 may be smoothly discharged. In this case, an approximate width W of the separation block 115 may be 1.2 to 2.5 (approximately) times an interval D between burner ports 112*b* and 112*c*. When the approximate width W of the separation block 115 is less than 1.2 times of the interval D1 between the burner ports 112-1 and 112-2, there is a problem in that flames may be merged and thus lengthened and carbon dioxide may be generated and thus combustibility may be degraded. In addition, when the approximate width W of the separation block 115 is more than 2.5 times the interval D1 between the burner ports 112-1 and 112-2, there is a problem in that flame carryover is poor, it is difficult to increase a burner port area and, thus, output power of flame is reduced.

As seen from Tables 1 to 3, the approximate width W of the separation block 115 may be supported according to an experimental result.

TABLE 1

| Width (mm) of separation block | 1.0 | 1.1 | 1.2 | 1.3 | 1.4 | 1.5 | 1.6 |
|---|---|---|---|---|---|---|---|
| flame state of adjacent burner ports | Merge Large | Merge Small | Separate | Separate | Separate | Separate | Separate |
| Flame length (portion above grate)(mm) | 5 | 4.5 | 3 | 2.5 | 2.2 | 2.2 | 2.2 |
| $CO_{AFCO}$(%) | 0.035 | 0.025 | 0.012 | 0.01 | 0.008 | 0.007 | 0.007 |

As shown in Table 1 above, when the approximate width W of the separation block 115 is less than 1.2 mm, flames of adjacent burner ports are merged and lengthened. In this case, when a cooking container with a bottom diameter of 270 mm is put on a grate 30 and a length of flame climbing above the grate 30 is measured, it may be seen that the length of flame is remarkably reduced when the approximate width W of the separation block 115 is less than 1.2 mm.

In addition, when the approximate width W of the separation block 115 is greater than or equal to 1.2 mm, $CO_{AFCO}$ is remarkably reduced to 0.012% or less. This means that flames are not merged and secondary air is smoothly supplied to each flame to improve combustibility.

TABLE 2

| Width (mm) of separation block | 2.2 | 2.3 | 2.4 | 2.5 | 2.6 | 2.7 | 2.8 |
|---|---|---|---|---|---|---|---|
| Flame carryover(%) | 100 | 100 | 100 | 100 | 90 | 70 | 30 |

Figure 6:
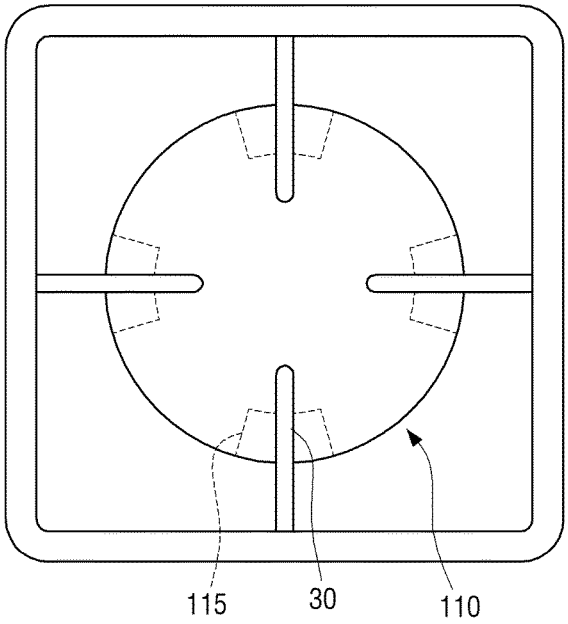
FIG. 6 is a plan view illustrating a state in which a grate is disposed on a separation block.

As shown in Table 2 above, when the approximate width W of the separation block 115 is equal to or less than 2.5 mm, flame carryover is 100% but when the approximate width W of the separation block 115 is more than 2.5 mm, flame carryover is remarkably degraded. As such, it may be seen that, when the approximate width W of the separation block 115 is greater than or equal to 2.5 mm, a distance between flames is increased and thus flames are not satisfactorily propagated. FIG. 6 is a plan view illustrating a state in which the grate 30 is disposed on the separation block 115.

Referring to FIG. 6, the separation block 115 may be positioned below the grate 30 and, thus, the flame F1 of the upper burner 110 may be prevented and minimized from contacting the grate 30, thereby contributing to reduce a boiling time.

As such, the separation block 115 may allow secondary air to more contact the flame F1 of the upper burner 110 so as to prevent flames from being merged and to enhance combustibility, thereby enhancing output of the upper burner 110. Accordingly, when the separation block 115 is applied to a small size burner, strong flame may be maintained.

Although the present disclosures discloses that the structure of the separation block 115 is applied to a gas burner apparatus with a flow channel for supply of secondary air, the present disclosure is not limited thereto and, thus, the present disclosure may be applied to various structures in which the flow channel for supply of secondary air is omitted, secondary air is directly supplied to the periphery of a burner port of a burner, or secondary air is supplied between upper and lower burners, and the aforementioned flame merge and increase in a length of flame may be prevented to maintain strong flame.

In general, as a burner port area is maximized and supply of mixture gas is increased, burner input may be increased. As such, in order to increase burner input, a burner is enlarged and flame injected from the burner is lengthened, in general. As such, when the burner is enlarged and flame is lengthened, this may adversely affect efficiency, a boiling time (time until a predetermined temperature is reached from another predetermined temperature by heating a predetermined amount of water contained in the cooking container 9 at maximum input), safety, etc. Accordingly, conditions such as a limited interval between the grate and upper and lower burners, a degree by which flame droops when a cooking container is put on the grate, lifting/flashback/incomplete combustion of flames are satisfied and, also, an appropriate area of a burner port may be determined in consideration of safety requirement of each country and, accordingly, input of the burner and the size of the burner may be determined.

The upper burner 110 according to the present disclosure may have a large burner port area or high burner port load (value obtained by dividing input of a burner by a burner port area) so as to achieve high output. Accordingly, the upper burner 110 may have a reduced burner size while having high output. In this case, as the burner port area of the upper burner 110 and the burner port load is increased, high output may be achieved although the upper burner 110 has a small size. To this end, as described above, primary air may be supplied to the chamber C1 of the upper burner 110 and secondary air may be sufficiently supplied to the first path S1 between the upper burner 110 and the lower burner 130 in order to prevent flames from lifting.

Referring back to FIGS. 2 and 3, the lower burner 130 may be used for simmering, as described above. Similarly to the upper burner 110, the lower burner 130 may include a head 131 with an open upper portion and a cap 133 for closing the upper portion of the head 131.

The head 131 of the lower burner 130 may include the through hole 132 that is formed through a center of the head 131 so as to allow the shielding member 159 of the orifice holder 150 to pass therethrough. In this case, the through hole 132 may be formed with a larger diameter than the shielding member 159 of the orifice holder 150. Accordingly, an inner circumference surface of the through hole 132 may be spaced apart from an external surface of the shielding member 159 of the orifice holder 150 to form a third path S3. In addition, the head 131 of the lower burner 130 may be configured in such a way that a portion of a lower portion is spaced apart from the support plate 101 and a flange portion 150*a* of the orifice holder 150 to form a fourth path S4. In this case, the third path S3 may have one side connected to the first path S1 and the other side connected to the fourth path S4.

Figure 7:
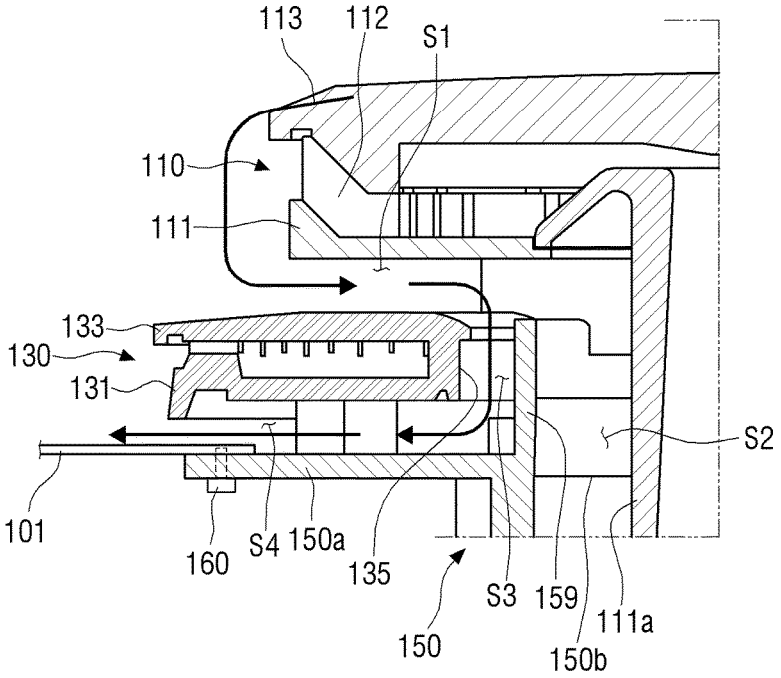
FIG. 7 is an enlarged cross-sectional view of a liquid (for example, soup) discharge path of the gas burner apparatus illustrated in FIG. 3A.

FIG. 7 is an enlarged cross-sectional view of a flow path for discharging soup of the gas burner apparatus 100 illustrated in FIG. 2.

Referring to FIG. 7, first, third, and fourth paths S1, S3, and S4 may form the flow path for discharging liquid (for example, soup). The flow path for discharging soup may prevent soup that overflows the cooking container 9 from flowing into a lower portion of the support plate 101 or an internal portion of the orifice holder 150, preventing a mal-operation of the cooking apparatus 1.

The flow path for discharging soup may displace another flow path for supplying secondary air to the periphery of the upper burner 110. That is, air around the lower burner 130 may be sequentially moved through the fourth path S4, to the third path S3, and to the first path S1 to supply to the periphery of the upper burner 110. However, the amount of secondary air that is sequentially supplied through the second path S2 and the first path S1 may be larger than the amount of secondary air supplied through the flow paths of S1, S3 and S4 for discharging soup. Accordingly, most secondary air supplied to the periphery of the upper burner 110 may be supplied through the first and second paths S1 and S2.

Referring back to FIG. 3, the head 131 of the lower burner 130 may include a mixture gas supply pipe 131*a* that is formed to extend downward. The mixture gas supply pipe 131*a* may be inserted into a guide pipe 158 of the orifice holder 150 so as to be spaced apart from an inner circumference surface of the guide pipe 158. In the mixture gas supply pipe 131*a*, gas injected from a nozzle 157 of the orifice holder 150 is mixed with primary air. In the mixture gas supply pipe 131*a*, a negative pressure may be formed by gas injected into the mixture gas supply pipe 131*a* at high speed. Accordingly, air present in the periphery of a lower end portion of the mixture gas supply pipe 131*a* may be used as primary air that is drawn into the mixture gas supply pipe 131*a* and mixed with gas.

A chamber C2 of the lower burner 130 may store mixture gas so as to continuously inject the flame F2 through a plurality of burner ports 135, 137 formed along the periphery of the lower burner 130.

The lower burner 130 may have a burner port with a smaller area than a burner port of the upper burner 110 and, accordingly, output of the lower burner 130 may be reduced compared with output of the upper burner 110 so as to achieve satisfactory simmering.

Some of a plurality of burner ports 135 and 137 of the lower burner 130 may be a main burner port for injecting flame and the other burner port 137 may be an auxiliary burner port for moving flame to the upper burner 110. In this case, the main burner port 135 may be disposed at a location corresponding to any one burner port 112 of a plurality of burner ports of the upper burner 110. Under such arrangement, the flame F2 of the lower burner 130 may contact the flame F1 of the upper burner 110, thereby preventing the flame F1 of the upper burner 110 from lifting. In addition, the auxiliary burner port 137 may be formed with a narrower burner port area than the main burner port 135 so as to form small-size flame for enabling flame carryover of flame injected from the auxiliary burner port 137. Referring back to FIGS. 2 and 3, the orifice holder 150 may include the flange portion 150*a* that is detachably fixed to a bottom surface of the support plate 101 through a plurality of coupling screws 160. In addition, the orifice holder 150 may include a first gas supply pipe 151 and a second gas supply pipe 155 that are each connected to a gas supply source (not shown) through a predetermined connection tube (not shown).

The first gas supply pipe 151 may be fixed to the flange portion 150*a* through a connection member 152. The first gas supply pipe 151 may include a nozzle support 154 disposed to correspond to an opening of a lower side of the mixture gas supply pipe 111*a* of the upper burner 110. The nozzle support 154 may include the nozzle 154 installed therein for injecting gas into the mixture gas supply pipe 111*a* of the upper burner 110. When the nozzle 154 injects gas into the mixture gas supply pipe 111*a* of the upper burner 110, air (which is used as secondary air) around a lower end portion of the mixture gas supply pipe 111*a* of the upper burner 110 may be drawn into the mixture gas supply pipe 111*a* of the upper burner 110 and mixed with gas in the mixture gas supply pipe 111*a* of the upper burner 110 according to Venturi effect.

The second gas supply pipe 155 may include a nozzle support 156 that is disposed to correspond to an opening of a lower side of the mixture gas supply pipe 131*a* of the lower burner 130. The nozzle support 156 may include the nozzle 157 installed therein for injecting gas into the mixture gas supply pipe 131*a* of the lower burner 130. In this case, the second gas supply pipe 155 may include the guide pipe 158 that extends to simultaneously surround the nozzle support 156 and the mixture gas supply pipe 131*a* of the lower burner 130. The second gas supply pipe 155 may be fixed to a flange portion 158*a* through the guide pipe 158. When the nozzle 157 injects gas into the mixture gas supply pipe 131*a* of the lower burner 130, air (which is used as secondary air) around a lower end portion of the mixture gas supply pipe 131*a* of the lower burner 130 may be drawn into the mixture gas supply pipe 131*a* of the lower burner 130 and mixed with gas in the mixture gas supply pipe 131*a* of the lower burner 130 according to Venturi effect.

The orifice holder 150 may include a through hole 150*b* that is formed through a center of the orifice holder 150 so as to allow the mixture gas supply pipe 111*a* of the upper burner 110 to pass therethrough. In this case, the through hole 150*b* of the orifice holder 150 may include the shielding member 159 that is shaped like a tub with a predetermined height and extends toward the upper burner 110. In this case, the shielding member 159 may be positioned to approximately correspond to an upper surface of the cap 133 of the lower burner 130. Accordingly, secondary air supplied through the second path S2 may be smoothly moved to the first path S1 without interfering with an upper end of the shielding member 159.

An inner circumference surface of the shielding member 159 of the orifice holder 150 may be spaced apart from an outer circumferential surface of the mixture gas supply pipe 111*a* of the upper burner 110 to form the second path S2. The shielding member 159 may partition the second and third paths S2 and S3 and, simultaneously, constitute the second and third paths S2 and S3.

Although the present embodiment in which the orifice holder 150 includes the shielding member 159 has been described, the present disclosure is not limited and, thus, the shielding member 159 may extend in the through hole 103 of the support plate 101. That is, the shielding member 159 may have a lower end that extend around the through hole 103 of the support plate 101 and may be formed toward the upper burner 110 with a predetermined height. In this case, the through hole 103 of the support plate 101 may have a reduced diameter so as to extend up to a location of the shielding member 159 illustrated in FIG. 3.

Needless to say, the orifice holder 150 may be integrally formed with the support plate 101 and, that is, the flange portion 150*a* of the orifice holder 150 may be integrally formed with the support plate 101.

In the gas burner apparatus 100, an outline of the upper burner 110 may be formed like an approximately circular shape and an outline of the lower burner 130 may also be formed like an approximately circular shape. In this case, a diameter of the outline of the upper burner 110 may be smaller than a diameter of the outline of the lower burner 130 in order to minimize supply of secondary air discharged to the first path S1 to the burner ports 135 and 137 of the lower burner 130 and to supply most secondary air to the burner ports 112 of the upper burner 110.

Figure 8:
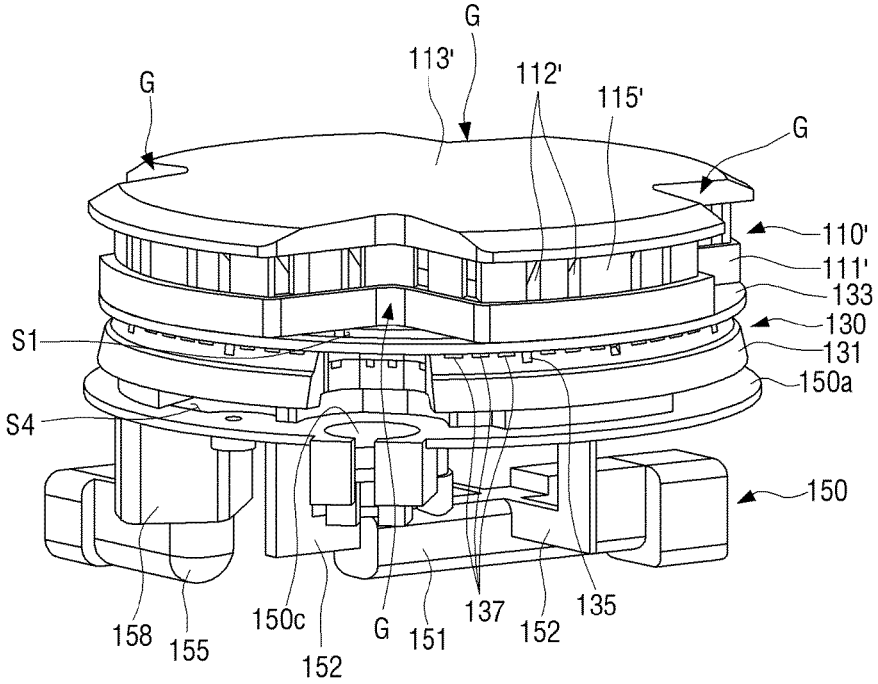
FIG. 8 is a perspective view illustrating another example of a gas burner apparatus included in a cooking apparatus according to an exemplary embodiment of the present disclosure.
Figure 9:
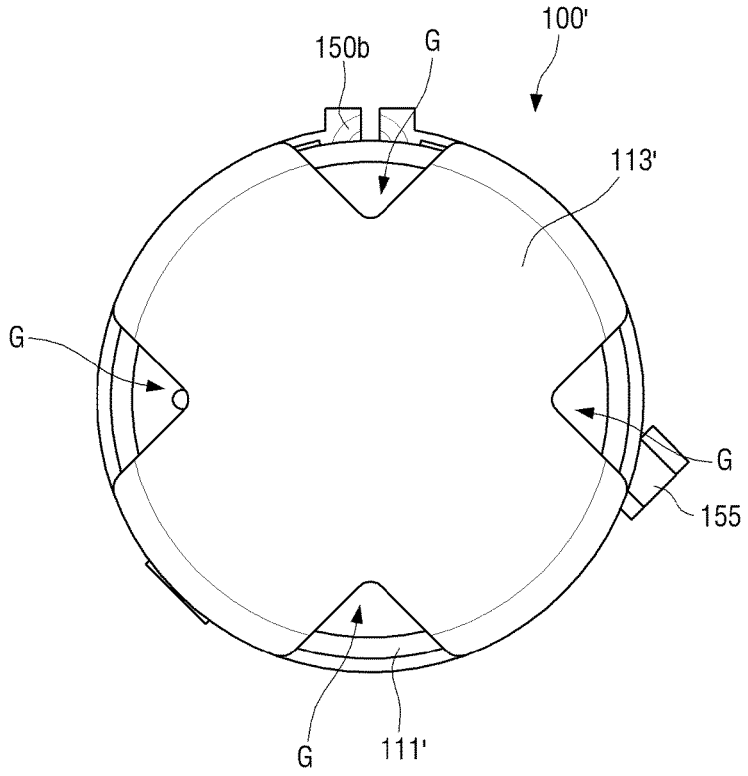
FIG. 9 is a plan view of the gas burner apparatus illustrated in FIG. 8.
Figure 10:
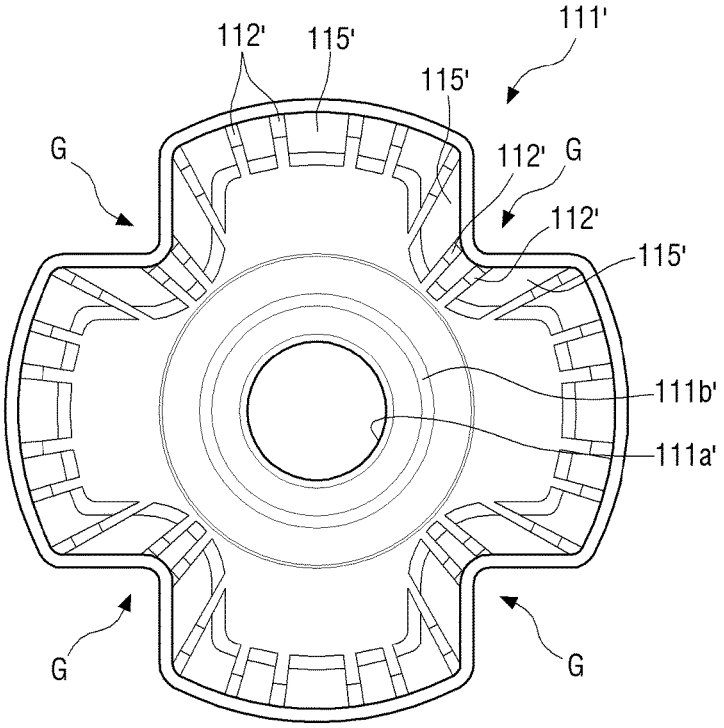
FIG. 10 is a perspective view of another example of a gas burner apparatus included in a cooking apparatus according to an exemplary embodiment of the present disclosure.
Figure 11:
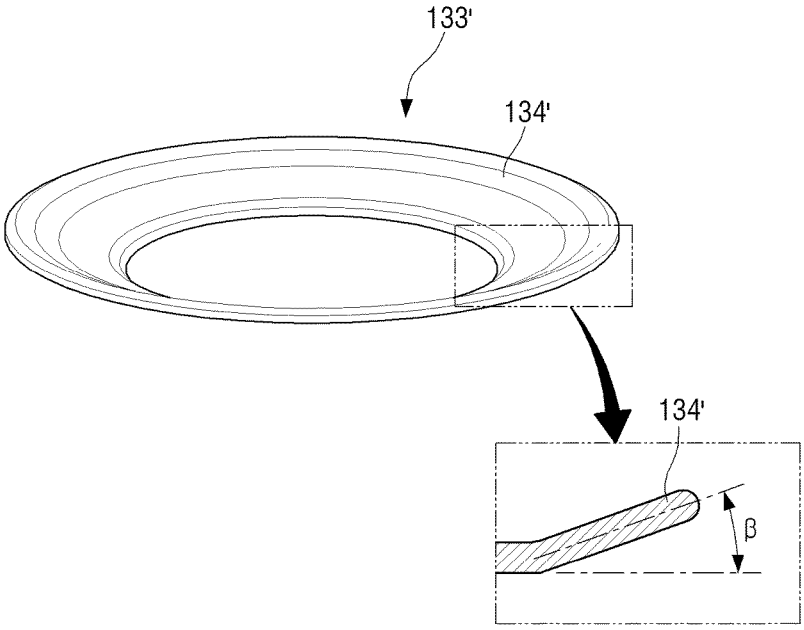
FIG. 11 is a diagram illustrating another example illustrating a cap of a lower burner.

Hereinafter, with reference to FIGS. 8 to 10, a structure of a gas burner apparatus 100' according to another exemplary embodiment of the present disclosure will be described in detail. FIG. 8 is a perspective view illustrating another example of a gas burner apparatus included in a cooking apparatus according to an exemplary embodiment of the present disclosure. FIG. 9 is a plan view of the gas burner apparatus illustrated in FIG. 8. FIG. 10 is a perspective view of another example of a gas burner apparatus included in a cooking apparatus according to an exemplary embodiment of the present disclosure. FIG. 11 is a diagram illustrating another example illustrating a cap of a lower burner.

A structure of the gas burner apparatus 100' illustrated in FIGS. 8 to 10 is almost the same as the aforementioned gas burner apparatus 100. Accordingly, the same components among components of the gas burner apparatus 100' as the aforementioned gas burner apparatus 100 are denoted by the same reference numerals, a detailed description thereof will be omitted, and the gas burner apparatus 100' will be described in terms of a difference from the aforementioned gas burner apparatus 100.

Referring to FIG. 8, the gas burner apparatus 100' may be configured in such a way that an upper burner 110' is formed like an approximate cross and the lower burner 130 is formed like an approximate circle. In this case, an outline of the upper burner 110' may partially correspond to an outline of the lower burner 130. The upper burner 110' and the lower burner 130 may be stacked so as not to be spaced apart from each other unlike the aforementioned first and second burners 110 and 130 of the aforementioned gas burner apparatus 100. As such, when the upper burner 110' and the lower burner 130 are not spaced apart from each other, secondary air may be stably supplied to burner ports 112' formed in a concave portion G of the upper burner 110' from a lower side of the orifice holder 150 through an internal portion of the second burner 130.

The upper burner 110' of the gas burner apparatus 100' may include four concave portions G. The plurality of concave portions G may allow flames generated by the upper burner 110' to be positioned in an internal side of a bottom surface of the cooking container 9 so as to reduce a cold spot of the cooking container 9 and to increase a hot spot, thereby reducing a boiling time.

Like the aforementioned upper burner 110 (refer to FIG. 3A), the plurality of burner ports 112' may be formed along the periphery of the upper burner 110' while a head 111' and a cap 113' are coupled to each other. In this case, the head 111' may include a separation block 115' for widening an interval between the burner ports 112'.

Some of the plurality of burner ports 112' may be formed adjacent to the concave portion G of the upper burner 110'. In this case, secondary air discharged from the first path S1 is sufficiently supplied toward the burner ports 112' formed adjacent to the concave portion G and, thus, flames injected from the burner ports 112' adjacent to the concave portion G may be satisfactorily injected with the same degree as flames injected from the burner ports 112' that are not formed adjacent to the concave portion G. In this case, secondary air supplied to the first path S1 may be supplied from a lower portion of the support plate 101 or a lower portion of the orifice holder 150.

The auxiliary burner port 137 for flame carryover among the plurality of burner ports 135 and 137 of the lower burner 130 may be disposed at a location corresponding to the concave portion G of the upper burner 110'. Thus, an amount of flames injected from the auxiliary burner port 137 of the lower burner 130, which contact secondary air supplied to the concave portion G through the first path S1, may be remarkably reduced. Accordingly, flames injected from the burner ports 112' formed in the concave portion G may sufficiently contact secondary air so as to prevent frame merge and to facilitate smooth combustion. Accordingly, output of the upper burner 110' may be increased.

Secondary air supplied to the burner ports 112' that are not formed in the concave portion G may be present around the upper burner 110'. Similarly, secondary air supplied to the burner ports 135 of the lower burner 130 may also be present around the lower burner 130.

Although an example in which the outline of the upper burner 110' is formed like a cross as illustrated in FIG. 8 has been described, the present disclosure is not limited thereto and, thus, the outline of the upper burner 110' may be formed like various non-circular shapes. In this case, the non-circular upper burner includes at least one concave portion that does not exceed an outline of a lower burner and, thus, flames injected from the upper burner 110' may be positioned adjacently to a center of a bottom of the cooking container 9 so as to minimize a cold spot of the cooking container 9 and to reduce a boiling time.

In FIG. 8, a non-described reference numeral 150*c* is an installment groove in which a spark plug (not shown) for generating spark in mixture gas supplied to the lower burner 130 to form flames is installed. The spark plug and the installment groove may also be included in the aforementioned gas burner apparatus 100 and a gas burner apparatus 100" to be described later.

With reference to FIG. 10, arrangement of a plurality of burner ports formed in the upper burner 110' will be described below. FIG. 10 is a plan view of a head of the gas burner apparatus illustrated in FIG. 8.

Like the aforementioned upper burner 110 (refer to FIG. 5), the upper burner 110' may also be configured in such a way that the separation block 115' is disposed between the pair of adjacent burner ports 112' in order to achieve high output while minimizing the size of the upper burner 110'.

Referring to FIG. 11, a cap 133' of the lower burner 130 may be formed in such a way that a peripheral portion 134' is inclined downward to a center from the outside so as to satisfactorily discharge soup. In this case, an inclination angle β may be 5 degrees or more. In this case, when the inclination angle β of the peripheral portion 134' is less than 5 degrees, there is a problem in that soup is not smoothly discharged and flown.

Accordingly, when soup overflowing the cooking container 9 (refer to FIG. 3A) drops on the cap 133' of the lower burner 130, the cap 133' of the lower burner 130 may guide the soup to rapidly flow to the head 131 of the lower burner 130 using the inclination angle β and soup introduced to the head 131 may evaporate in the head 131. Vapor generated as soup evaporates is separated from the first path S1 and, thus, secondary air that is supplied to the burner ports 112' of the upper burner 110' through the first path S1 may be shut so as to prevent flames from being extinguished.

Figure 12:
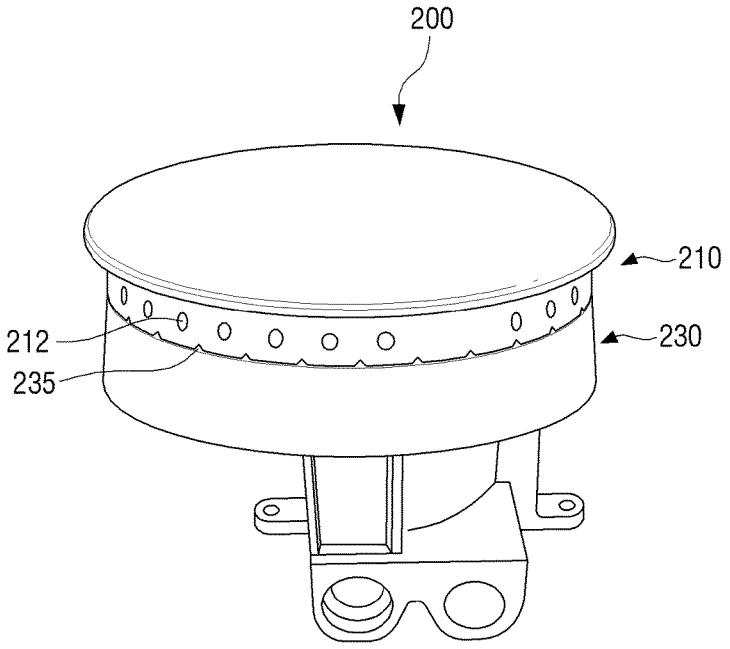
FIG. 12 is a diagram illustrating an integration stack-type gas burner apparatus according to the present disclosure.

Needless to say, as illustrated in FIG. 12, the present disclosure may be applied to a stack-type gas burner apparatus 200 in which an upper burner 210 and a lower burner 230 are integrally formed. In FIG. 12, a non-described reference numeral 212 is a burner port of the upper burner 210 and a reference numeral 235 is a burner port of the lower burner 230.

Figure 13:
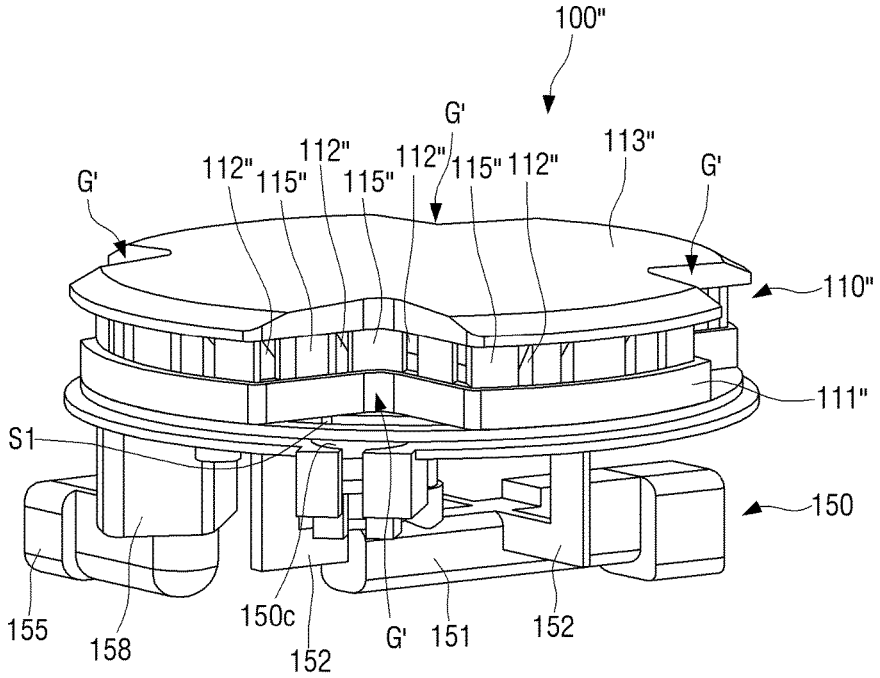
FIG. 13 is a perspective view of another example of a gas burner apparatus included in a cooking apparatus according to an exemplary embodiment of the present disclosure.

Hereinafter, with reference to FIG. 13, another example of a structure of the gas burner apparatus 100" will be described. FIG. 13 is a perspective view of another example of a gas burner apparatus included in a cooking apparatus according to an exemplary embodiment of the present disclosure.

The gas burner apparatus 100" illustrated in FIG. 13 is a single-type gas burner apparatus unlike the aforementioned stack-type gas burner apparatuses 100 and 100'. That is, the gas burner apparatus 100" may include only a burner 110" corresponding to an upper burner of the aforementioned gas burner apparatuses 100 and 100' but not a burner corresponding to a lower burner of the aforementioned gas burner apparatuses 100 and 100'. That is, the gas burner apparatus 100" may be configured by omitting a lower burner 130' from the aforementioned gas burner apparatus 100' and including the upper burner 110' and the orifice holder 150. Accordingly, most components of the gas burner apparatus 100" are the same as those of the aforementioned gas burner apparatus 100' and, thus, a detailed description of the same components as the aforementioned gas burner apparatus 100' will be omitted and only a difference from the aforementioned gas burner apparatus 100' will be described.

An outline of the burner 110" is formed like a non-circular shape like the upper burner 110' of the aforementioned gas burner apparatus 100' and the structure of the burner 110" may also be the same as the upper burner 110' and the burner 110" of the aforementioned gas burner apparatus 100'. That is, the burner 110" may include a head 111" and a cap 113" for opening and closing an upper opening of the head 111". In this case, the head 111" may be installed so as not to be spaced apart from an upper side of a support plate.

At least one burner port 112" may be formed in the concave portion G of the burner 110". Flames injected from the burner port 112" formed in the concave portion G may sufficiently contact secondary air supplied through the first path S1 disposed below the burner 110" so as to be completely combusted. Accordingly, the burner 110" may reduce a cold spot and increase a hot spot with respect to the cooking container 9, thereby remarkably reducing a boiling time.

Figure 14:
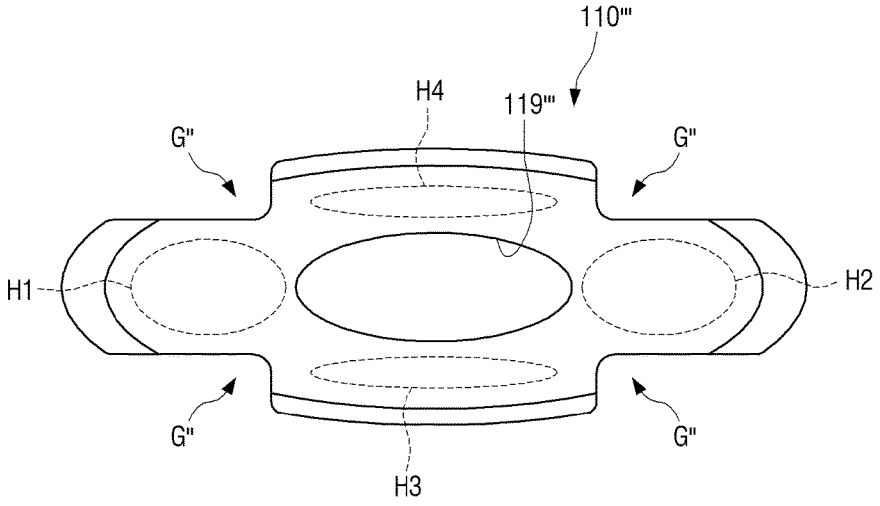
FIG. 14 is a plan view illustrating another example of a cap of a burner illustrated in FIG. 13.
Figure 15:
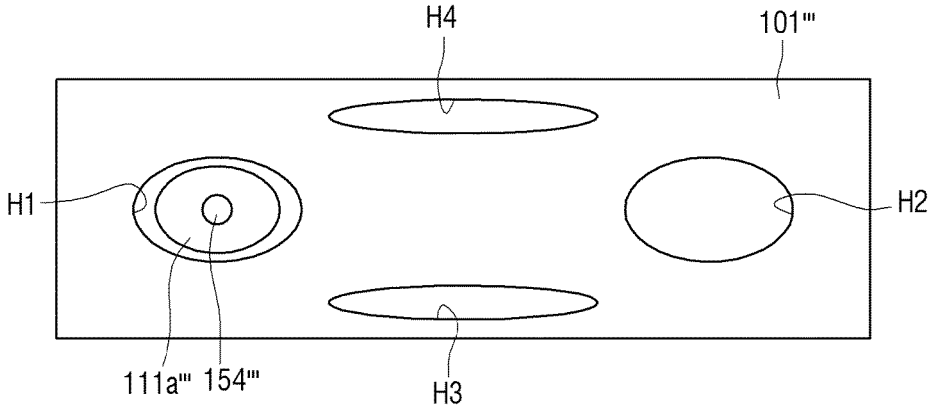
FIG. 15 is a plan view illustrating arrangement of a nozzle and a base plate corresponding to the cap of the burner illustrated in FIG. 14.

FIG. 14 is a plan view illustrating another example of a cap of a burner illustrated in FIG. 13. FIG. 15 is a plan view illustrating arrangement of a nozzle and a base plate corresponding to the cap of the burner illustrated in FIG. 14.

Needless to say, as illustrated in FIG. 14, a single burner 110'" may be formed to have a predetermined length. The burner 110'" may be configured in such a way that a plurality of burner ports are arranged along an outline of the burner 110'" and at least one burner port is formed in a plurality of concave portions G". The burner 110'" may include a through hole 119'" formed so as to inject flames to the center and a plurality of burner ports that are formed along an inner circumference portion of the through hole 119'" at a predetermined interval.

Referring to FIG. 15, when the burner 110'" is formed to have a predetermined length, a support plate 101'" may include holes H1, H2, H3, and H4 for supply of a plurality of secondary air, which are formed in consideration of a shape of the burner 110". That is, the holes H1, H2, H3, and H4 for supply of a plurality of secondary air may be formed at locations corresponding to protrusions of the burner 110'", and although the holes H1, H2, H3, and H4 are formed like an oval as illustrated in FIG. 12, the shape may not be limited to an oval and may have various shapes such as a rectangular shape.

Any one H1 of the holes H1, H2, H3, and H4 for supply of a plurality of secondary air may include a mixture gas supply pipe 111*a*'" and a nozzle 154'" for supplying mixture gas to a chamber in the burner 110".

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A gas burner apparatus comprising:

a first burner to receive supplied gas mixed with a first primary air from a first primary air supply flow path and to inject flames through a plurality of first burner ports formed along an edge of the first burner;

a second burner, spaced apart from a lower side of the first burner, to receive the supplied gas mixed with a second primary air from a second primary air supply flow path and to inject flames through a plurality of second burner ports formed along an edge of the second burner;

a support plate on which the second burner is disposed; and a secondary air supply flow channel to supply secondary air to the first burner, the secondary air supply flow channel including a first secondary air supply flow path formed between the lower side of the first burner and a top side of the second burner in a direction parallel to the lower side of the first burner and a second secondary air supply flow path starting from an area lower than the support plate, the first and second paths being connected to each other.

2. The gas burner apparatus as claimed in claim 1, wherein:

the first burner comprises a mixture gas supply pipe to supply the supplied gas and that is formed sequentially through the second burner and a through hole of the support plate; and the through hole of the support plate has an inner circumference surface that is spaced apart from an outer circumferential surface of the mixture gas supply pipe.

3. The gas burner apparatus as claimed in claim 2, wherein the support plate is coupled to a shielding rib that extends toward the first burner from the through hole of the support plate.

4. The gas burner apparatus as claimed in claim 3, wherein the shielding rib is spaced apart from the mixture gas supply pipe to form the second secondary air supply flow path between the shielding rib and the mixture gas supply pipe.

5. The gas burner apparatus as claimed in claim 3, further comprising:

a liquid discharging flow path comprising the secondary air supply channel between the first and second burners, a path between an external side of the second burner and an external side of the shielding rib, and the path between the external upper surface of the support plate and the second burner.

6. The gas burner apparatus as claimed in claim 2, further comprising an orifice holder detachably coupled to an interior lower surface of the support plate to supply the supplied gas to at least the first burner, wherein the orifice holder is shaped like a tub surrounding the mixture gas supply pipe of the first burner and includes a shielding member spaced apart from an external side of the mixture gas supply pipe of the first burner.

7. The gas burner apparatus as claimed in claim 6, wherein:

the shielding member of the orifice holder is inserted into the through hole of the support plate; and a path between an internal surface of the shielding member of the orifice holder and the external side of the mixture gas supply pipe of the first burner forms a portion of the second secondary air supply flow path.

8. The gas burner apparatus as claimed in claim 1, wherein outlines of the first and second burners are the same shape.

9. The gas burner apparatus as claimed in claim 1, wherein:

outlines of the first and second burners are different shapes; and at least a portion of the first burner is positioned within the outline of the second burner.

10. The gas burner apparatus as claimed in claim 9, wherein:

the outline of the first burner is formed like a non-circle and the first burner comprises at least one concave portion;

the outline of the second burner is formed like a circle; and at least one of the first burner ports of the first burner is formed in the at least one concave portion of the first burner.

11. The gas burner apparatus as claimed in claim 1, wherein some of the plurality of first burner ports of the first burner are spaced apart from each other at same interval and remaining of the first burner ports are spaced apart from each other at different intervals.

12. The gas burner apparatus as claimed in claim 1, wherein the plurality of first burner ports of the first burner are spaced apart from each other at different intervals.

13. The gas burner apparatus as claimed in claim 1, wherein the first burner comprises at least one separation block with a width of approximately 1.2 to 2.5 times an interval between adjacent first burner ports of the first burner so as to widen an interval between the adjacent first burner ports.

14. The gas burner apparatus as claimed in claim 1, wherein the plurality of burner ports of the first burner are inclined upward.

15. The gas burner apparatus as claimed in claim 14, wherein:

the plurality of first burner ports of the first burner are formed by a head and a cap for closing the head, included in the first burner; and the head comprises a first inclined block with a first inclination angle and a second inclined block with a second inclination angle.

16. The gas burner apparatus as claimed in claim 1, wherein the plurality of second burner ports of the second burner are inclined upward.

17. The gas burner apparatus as claimed in claim 1, wherein the second burner ports of the second burner comprise at least one main burner port to output a supplied power to the second burner and an auxiliary burner port to move flames to the first burner.

18. The gas burner apparatus as claimed in claim 17, wherein the at least one main burner port of the second burner is disposed directly below any one of the plurality of first burner ports of the first burner.

19. The gas burner apparatus as claimed in claim 17, wherein a total area of the plurality of first burner ports of the first burner is larger than a total area of the main burner port of the second burner.

20. A cooking apparatus comprising:

a body;

a gas burner apparatus disposed above the body; and an adjuster disposed in the body and configured to combust the gas burner apparatus and to adjust intensity of output power, wherein the gas burner apparatus comprises at least one pair of first and second burners, the first burner to receive supplied gas mixed with a first primary air from a first primary air supply flow path and to inject flames through a plurality of first burner ports formed along an edge of the first burner;

the second burner disposed on a support plate, spaced apart from a lower side of the first burner, to receive the supplied gas mixed with a second primary air from a second primary air supply flow path and to inject flames through a plurality of second burner ports formed along an edge of the second burner;

a support plate on which the second burner is disposed; and a secondary air supply flow channel to supply secondary air to the first burner, the secondary air supply flow channel including a first secondary air supply flow path formed between the lower side of the first burner and a top side of the second burner in a direction parallel to the lower side of the first burner and a second secondary air supply flow path starting from an area lower than the support plate, the first and second paths being connected to each other.

* * * * *